US008265288B2

(12) United States Patent
Beck et al.

(10) Patent No.: US 8,265,288 B2
(45) Date of Patent: Sep. 11, 2012

(54) METHOD FOR ADAPTING A HEARING AID BY A PERCEPTIVE MODEL

(75) Inventors: Frank Beck, Spardorf (DE); Matthias Fröhlich, Erlangen (DE); Matthias Latzel, Eggolsheim (DE); Henning Puder, Erlangen (DE); Andre Steinbuss, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 1083 days.

(21) Appl. No.: 12/220,476

(22) Filed: Jul. 24, 2008

(65) Prior Publication Data

US 2009/0034767 A1 Feb. 5, 2009

Related U.S. Application Data

(60) Provisional application No. 60/962,322, filed on Jul. 27, 2007.

(51) Int. Cl.
*H04R 29/00* (2006.01)
*H04R 25/00* (2006.01)

(52) U.S. Cl. ..... 381/60; 381/312; 381/314

(58) Field of Classification Search ..... 381/58, 381/60, 312, 314, 320, 321, 323; 600/559; 607/56, 57

See application file for complete search history.

(56) References Cited

U.S. PATENT DOCUMENTS

| | | | | |
|---|---|---|---|---|
| 6,731,997 | B2 * | 5/2004 | Hessel et al. | 700/98 |
| 7,162,323 | B2 * | 1/2007 | Brumback et al. | 700/118 |
| 7,467,022 | B2 * | 12/2008 | Bhagwat et al. | 700/98 |
| 2002/0111745 | A1 | 8/2002 | Bye et al. | |
| 2010/0191143 | A1 * | 7/2010 | Ganter et al. | 600/559 |

FOREIGN PATENT DOCUMENTS

| | | |
|---|---|---|
| EP | 0 661 905 A2 | 7/1995 |

* cited by examiner

*Primary Examiner* — Matthew W Such
*Assistant Examiner* — Scott Stowe

(57) ABSTRACT

The provision of an individually adapted hearing aid for a patient is intended to be effected more quickly. A method is therefore provided by which, firstly, hearing loss data, in particular an audiogram, are generated by a person skilled in the art for example an ENT specialist, and the hearing loss data are transmitted to a manufacturer. Using a perceptive model based on the hearing loss data, the manufacturer selects a hearing aid and matches the hearing aid to the patient by means of the perceptive model. Finally, the manufacturer delivers the adapted hearing aid directly or indirectly to the patient. Due to the simplified workflow during the adaptation, the waiting times for the provision of the hearing aid are reduced for the patient.

13 Claims, 3 Drawing Sheets

METHOD FOR ADAPTING A HEARING AID BY A PERCEPTIVE MODEL

CROSS REFERENCE TO RELATED APPLICATIONS

The present application claims the benefit of a provisional patent application filed on Jul. 27, 2007, and assigned application Ser. No. 60/962,322, which is incorporated by reference herein in its entirety.

FIELD OF THE INVENTION

The present invention relates to a method for providing a patient with an individually adapted hearing aid, it being possible to obtain an audiogram or other data related to the patient's hearing loss and to individually adjust the hearing aid accordingly.

BACKGROUND OF THE INVENTION

Hearing aids are portable hearing devices which are provided to the hard of hearing. In order to meet numerous individual needs, different types of hearing aids, such as behind-the-ear hearing aids (BTE), behind-the-ear with external receiver (RIC: receiver in the canal) and in-the ear hearing aids (ITE) for example, also concha hearing aids or canal hearing aids (ITE, CIC), are provided. The hearing aids listed as examples are worn on the outer ear or in the auditory canal. In addition, bone conductive hearing aids, implantable or vibro-tactile hearing aids are also available on the market. In these cases the defective hearing is stimulated either by mechanical or electrical means.

In principle the main components of hearing aids are an input transducer, an amplifier and an output transducer. The input transducer is usually an acoustic receiver, for example a microphone, and/or an electromagnetic receiver, for example an induction coil. The output transducer is usually realized as an electro-acoustic transducer, for example a miniature loudspeaker, or as an electromechanical transducer for example a bone conductive receiver. The amplifier is usually integrated in a signal processing unit. This basic construction is illustrated in the example of a behind-the-ear hearing aid in FIG. 1. One or more microphones 2 for receiving the sound from the environment are built into a hearing aid housing 1 to be worn behind the ear. A signal processing unit 3, that is likewise integrated in the hearing aid housing 1, processes and amplifies the microphone signals. The output signal of the signal processing unit 3 is transmitted to a loudspeaker or receiver 4, which outputs an acoustic signal. If necessary, the sound is transmitted to the eardrum of the wearer of the device via an acoustic tube that is located in the auditory canal by means of an otoplastic. The power supply of the hearing aid and in particular that of the signal processing unit 3, is provided by a battery 5 which is likewise integrated in the hearing aid housing 1.

Hearing aids have very complex signal processing algorithms and have to be individually adapted to the respective hearing loss of a patient. For this adaptation an audiogram is usually obtained for the patient by an ear, nose and throat (ENT) specialist. Based on this, a hearing aid type is selected and individually adjusted accordingly. This workflow for adapting the hearing aid usually involves the patient making frequent visits to the ENT specialist or acoustician. In addition it frequently requires repetitive feedback between a hearing aid manufacturer and an acoustician in order to select the actual, ideal hearing aid type in the course of the adaptation process, and to achieve the best setting for the patient. For this reason, this can result in very long waiting times for the patient during the provision of the hearing aid. The reason for this lies in poor patient management and the labor-intensive workflow for the adaptation.

The publication US 2002/0111745 A1 discloses a portable hearing analysis system. Here, parameters of a hearing response can be obtained by means of an audiometer. A response forecast is used to implement a first adjustment for a hearing aid.

Furthermore, the publication EP 0 661 905 A2 describes a method for adapting a hearing aid, and a corresponding hearing aid. Using a perceptive model, a psycho-acoustic variable, in particular the loudness, is obtained on the one hand for a standard group of people and on the other hand for a single individual. Correction data, by means of which the signal transmission at the hearing aid is designed or adjusted ex situ or controlled in situ, are determined on the basis of the difference between the two psycho-acoustic variables.

SUMMARY OF THE INVENTION

The object of the present invention consists in simplifying the workflow involved in providing a patient with an individually adapted hearing aid, thereby reducing the waiting time for the adapting of a hearing aid.

This object is achieved according to the invention by a method for providing a patient with an individually adapted hearing aid by generating hearing loss data which map a hearing loss, in particular an audiogram, by a first person skilled in the art, sending the hearing loss data from the first person skilled in the art to a manufacturer who selects a hearing aid by means of a perceptive model based on the hearing loss data, and adaptation by the manufacturer of the hearing aid to the patient by means of the perceptive model and delivery by the manufacturer of the adapted hearing aid directly or indirectly to the patient.

Advantageously, the perceptive model enables the manufacturer to forecast how the hard-of-hearing person will more or less perceive the sound amplified by the hearing aid. Consequently, on the basis of the patient's hearing loss data or audiogram the manufacturer can on his own purposefully select an appropriate type of hearing aid and carry out a corresponding basic adaptation.

If the hearing aid is an ITE type for which an individually adapted hearing aid shell is required, the manufacturer himself or a supplier can manufacture this hearing aid shell, provided the necessary anatomical data are supplied to him. Advantageously, it is therefore possible for the manufacturer to individually form the shell and individually adapt the electronics of the hearing aid as well.

In a variant of the workflow according to the invention the patient visits a second person skilled in the art who obtains from said patient the anatomical data relating to the auditory canal and sends it to the manufacturer or supplier. Moreover, it is usually only necessary for the patient to visit this second person skilled in the art—an acoustician (dispenser)—only once.

In order to obtain the anatomical data, the second person skilled in the art can take an impression of the patient's ear and scan this or scan the auditory canal directly. In every case the second person skilled in the art can then make this anatomical data available to the manufacturer, who can also take these data into account with the perceptive model, for example in relation to an open or occluded type of fitting.

According to a simplified variant, in particular for the provision of ITE hearing aids, the first person skilled in the art, usually an ENT specialist, also obtains the anatomical data relating to the patient's auditory canal in addition to the patient's hearing loss data or audiogram and sends this to the manufacturer or supplier of hearing aids or hearing aid shells. This spares the patient the visit to a second person skilled in the art, for example the acoustician or dispenser. Also in this case the first person skilled in the art can then take an impression of the patient's ear to obtain the anatomical data, scan this or directly scan the auditory canal.

In the simplest variant of the workflow the manufacturer delivers the adapted hearing aid directly to the patient. But he can also deliver the adapted hearing aid for the patient to an acoustician or a clinic, who/which trains the patient in the handling of the hearing aid. It is thus possible for the patient to receive suitable instruction for the initial wearing of the hearing aid and afterwards further patient care is also ensured.

As already mentioned above, the first person skilled in the art can be an ENT specialist and the second person skilled in the art an acoustician. These two persons skilled in the art then share the acquisition of the individual hearing loss and anatomical data, so that the waiting time for the manufacture or adaptation of the individual hearing aid can possibly be further reduced.

BRIEF DESCRIPTION OF THE DRAWINGS

The present invention is explained in more detail with the aid of the attached drawings, in which.

DETAILED DESCRIPTION OF THE INVENTION

The exemplary embodiments explained in more detail below represent preferred embodiments of the present invention.

Figure 1:
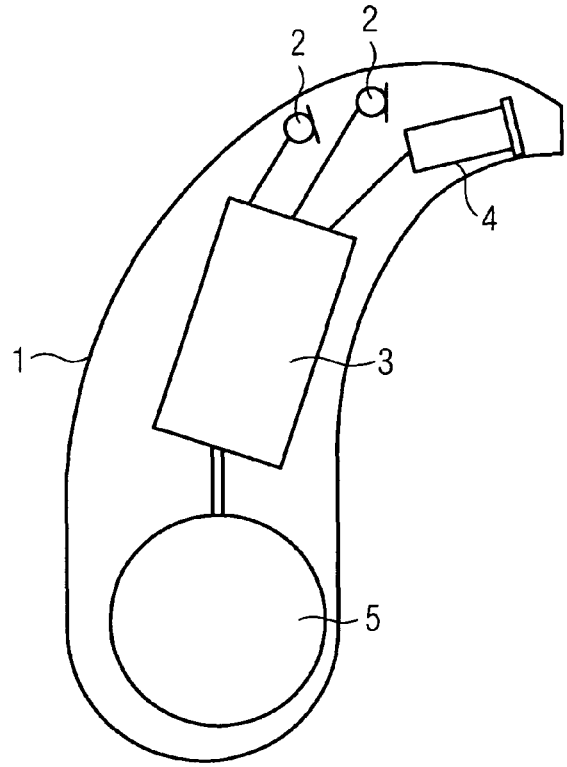
FIG 1 (PRIOR ART)
FIG. 1 shows the basic construction of a hearing aid according to the prior art.
Figure 2:
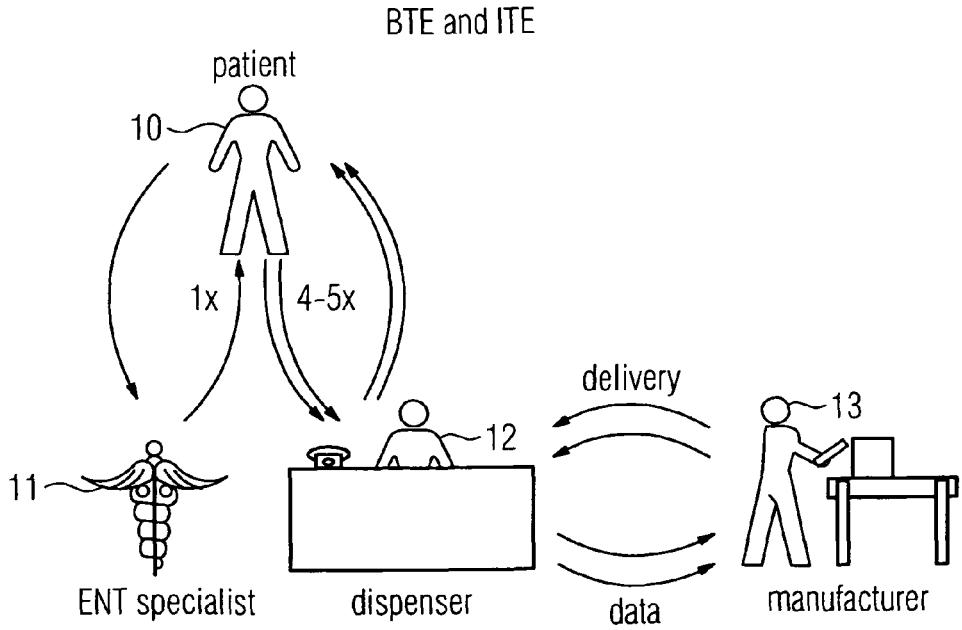
FIG. 2 shows a workflow arrangement for the adaptation of a hearing aid, without a perceptive model.

Firstly, for a better understanding of the invention, a workflow arrangement for adapting a BTE or ITE hearing aid without the assistance of a perceptive model is explained with the aid of FIG. 2. Accordingly, a patient 10 goes to an ENT (ear, nose and throat) specialist, to have his hearing examined. The ENT specialist 11 takes an audiogram of the patient 10 or obtains other data which map the hearing loss and makes a corresponding diagnosis. The patient 10 therefore has to visit the ENT specialist 11 at least once for the diagnosis to be made.

With the diagnosis, the patient 10 goes to an acoustician (dispenser) 12), who generates another audiogram of the patient 10. In addition, the acoustician 12 advises the patient 10 on the choice of a hearing aid. If necessary, for an ITE hearing aid the acoustician takes an impression of the patient's ear. The acoustician 12 then orders a selected hearing aid from a manufacturer 13. With the order, the acoustician 12 sends either the ear impression or appropriate scan data to the manufacturer 13, who then manufactures the hearing aid in accordance with the data from the acoustician 12 or the dispenser. After that, the manufacturer 13 delivers the completed device to the acoustician 12. In turn, the acoustician 12 again invites the patient 10 to see him to adjust the hearing aid. Here it is sometimes necessary for the manufacturer 13 to replace or improve the hearing aid. It is thus possible that several successive steps are necessary just between the acoustician 12 and the manufacturer 13.

For further adjustment, the patient 10 usually has to visit the acoustician 12 several times. Typically, four to five visits are necessary. In this case the acoustician 12 programs the hearing aid according to the requirements of the individual patient 10.

In fact, with such an adjustment using the workflow arrangement of FIG. 2, a good-quality adjustment of the hearing aid is usually obtained, but very many visits by the patient 10 are required. Frequently only marginal improvements are obtained during individual visits. If necessary, several hearing aids are ordered from the manufacturer 13 in one or more workflow steps, before a final selection can be made. All in all, a very large expenditure in relation to offers and time, or a long waiting time, is required before the patient receives his final, individual care.

According to the invention, in order to reduce the waiting time, a workflow is therefore proposed in which measurement data relating to the hearing loss, in particular the audiogram, are transmitted from the ENT specialist 11 directly to the manufacturer 13 or an appropriate marketing company for hearing aids. If necessary this data transmission can be achieved by means of a chip card, the Internet, etc. From a usual basic adjustment (first fit) and the perceptive model based on the audiogram, which delivers a psycho-acoustic perception variable for a physical acoustic signal value, the individual settings are implemented directly by the manufacturer or the marketing company, and the device is dispatched.

According to a first variant, the hearing aid is sent to an issuing or adaptation point. This can be an acoustician or a clinic, for example. Here the device is issued and, if necessary, instruction is given in its handling. According to another variant, the hearing aid is sent directly to the patient. After some time, for example three to four weeks of use, a personal examination date can be agreed with the acoustician or the clinic.

Figure 3:
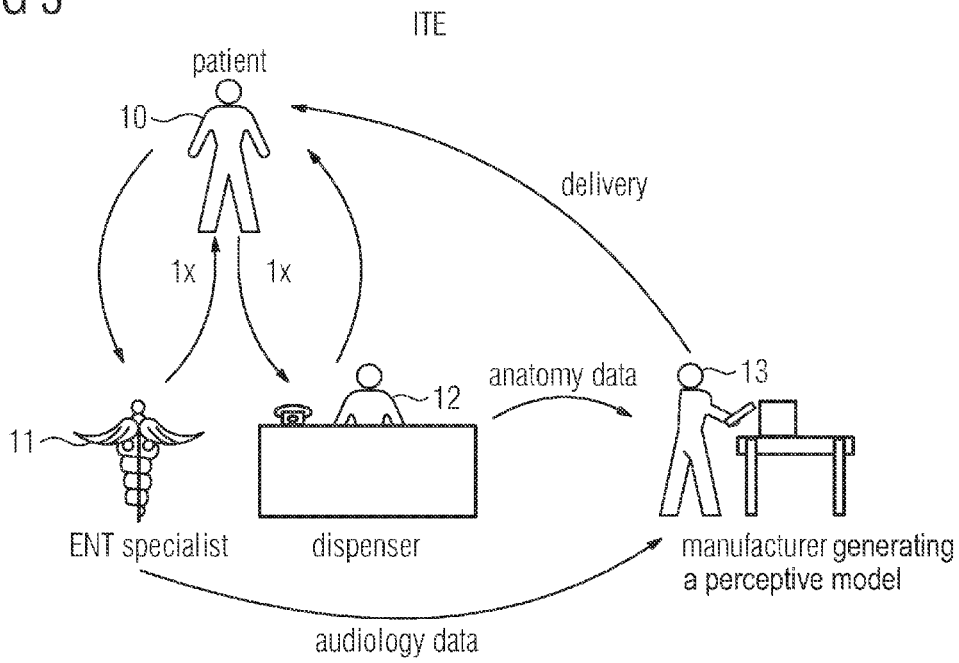
FIG. 3 shows a workflow arrangement for the adaptation of an ITE hearing aid according to a first embodiment with a perceptive model.

The workflow for the adaptation of an ITE hearing aid can be configured according to an embodiment as per FIG. 3. After this, as in the example of FIG. 2, the patient 10 likewise visits the ENT specialist 11, who then, however, sends the generated audiogram directly to the manufacturer 13. An ear impression must also be taken for the ITE hearing aid. For this the patient 10 pays one visit to a dispenser or acoustician 12. This specialist takes the ear impression and sends it or corresponding scan data (anatomical data) to the manufacturer 13. In all cases the auditory canal can also be directly scanned instead of the ear impression. For his part, with the aid of the audiogram (hearing loss data) the manufacturer 13 generates a perceptive model that is individual to the patient. The manufacturer selects the type of hearing aid with the aid of this perceptive model. Together with the data obtained by the acoustician 12, he then manufactures an appropriate hearing aid and matches it to the patient 10 by means of the perceptive model. Finally he delivers the adapted device directly to the patient or to the above-mentioned issuing or adaptation point.

Figure 4:
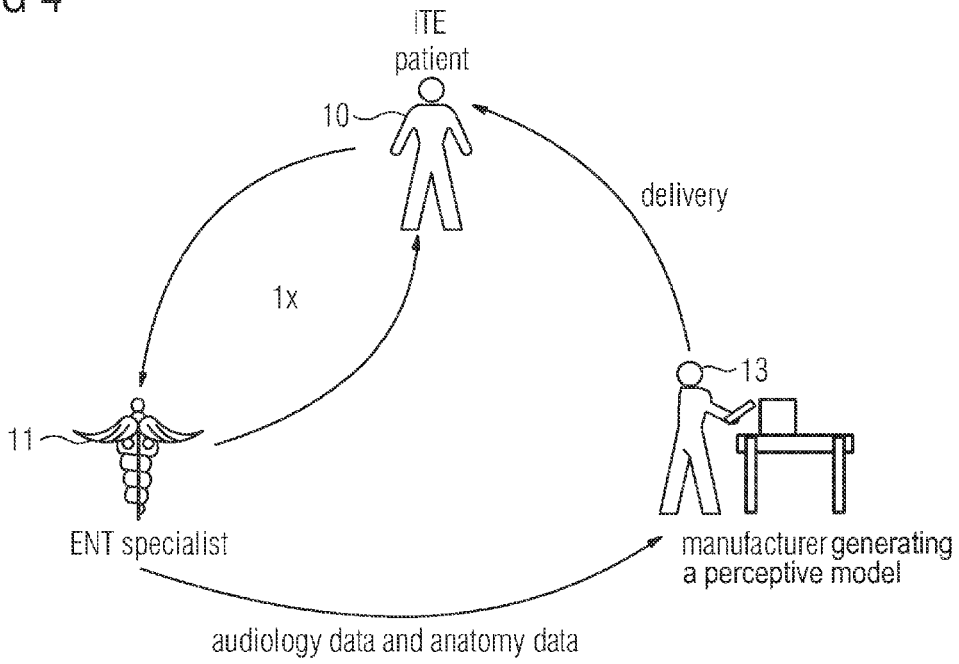
FIG. 4 shows a workflow arrangement for the adaptation of an ITE hearing aid according to a second embodiment with a perceptive model.

The workflow arrangement shown in FIG. 2 for adapting an ITE hearing aid can then be simplified if the ENT specialist 11 also takes the ear impression at the same time. A workflow arrangement relating to this is shown in FIG. 4. Following this, the patient 10 again visits the ENT specialist 11 for the diagnosis of his hearing defect. The ENT specialist not only makes the diagnosis but also takes an impression of the patient's 10 ear. The ENT specialist 11 now sends the audiogram (audiological data) obtained for the diagnosis and the data from the ear impression or the ear impression (anatomical data) itself directly to the manufacturer 13. As in the previous example, the latter now selects the hearing aid type by means of the audiogram and the perceptive model and manufactures an appropriate hearing aid. Likewise he matches the hearing aid to the perceptive model. Finally he again delivers it either directly to the patient 10 or indirectly to the appropriate issuing or adaptation point. Consequently the patient has the additional advantage that, compared to the example of FIG. 3, he has to visit the ENT specialist only once and not an acoustician as well. Furthermore, the coordination of data by the ENT specialist 11 and the acoustician 12 is eliminated in the example of FIG. 4.

Figure 5:
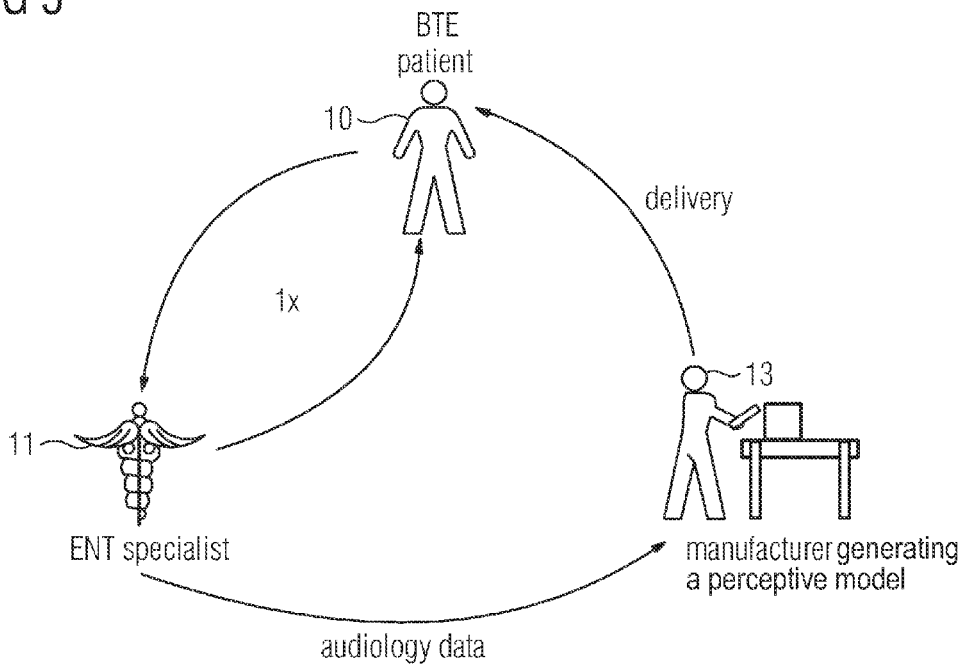
FIG. 5 shows a workflow arrangement for the adaptation of a BTE hearing aid with a perceptive model.

Following the workflow arrangement of FIG. 4, the adaptation of a BTE hearing aid can likewise be made very simple, because it is not necessary to take a patient's ear impression. The adaptation of a BTE hearing aid therefore results from the workflow outlined in FIG. 5. The patient 10 therefore visits an ENT specialist 11 for the generation of an audiogram and a diagnosis. The ENT specialist sends the audiogram to the manufacturer 13 who selects the hearing aid type by means of the perceptive model based on the audiogram and manufactures an appropriate hearing aid. As with the adaptation of ITE hearing aids, here again the manufacturer adapts the hearing aid with the help of the individualized perceptive model. He delivers the adapted hearing aid directly to the patient or to the appropriate issuing point.

With the adaptation of a BTE hearing aid in accordance with the workflow arrangement of FIG. 5, the patient 10 again benefits from the fact that he has to visit the ENT specialist 11 only once and does not have to pay any further visits to acousticians or marketing companies. This means that, due to the manufacture and adaptation of the hearing aid with the aid of the perceptive model, an appreciable time saving can be achieved for the patient. Overall, the provision rate can thus be increased since fewer process steps are necessary.

The invention claimed is:

1. A method for supplying a patient with an individually adapted hearing aid, comprising:

generating a hearing loss data that maps a hearing loss of the patient by a first person;

sending the hearing loss data to a hearing aid manufacturer;

generating a perceptive model individual to the patient based on the hearing loss data of the patient by the hearing aid manufacturer;

selecting the hearing aid by the hearing aid manufacturer with an aid of the perceptive model individual to the patient; and adapting the hearing aid to the patient using the perceptive model by the hearing aid manufacturer.

2. The method as claimed in claim 1, wherein the hearing loss data comprises audiogram data.

3. The method as claimed in claim 1, wherein the hearing aid is an in-the-ear hearing aid comprising an individually adapted hearing aid shell.

4. The method as claimed in claim 1, wherein the first person is an ear, nose and throat specialist.

5. The method as claimed in claim 1, further comprising generating an anatomical data of an auditory canal of the patient.

6. The method as claimed in claim 5, further comprising sending the anatomical data to the hearing aid manufacturer.

7. The method as claimed in claim 5, wherein the anatomical data is generated by taking an ear impression of the patient or directly scanning the auditory canal of the patient.

8. The method as claimed in claim 5, wherein the anatomical data is generated by the first person.

9. The method as claimed in claim 5, wherein the anatomical data is generated by a second person.

10. The method as claimed in claim 9, wherein the second person is an acoustician.

11. The method as claimed in claim 1, wherein the hearing aid is directly delivered to the patient by the hearing aid manufacturer.

12. The method as claimed in claim 1, wherein the hearing aid is delivered to an acoustician or a clinic by the hearing aid manufacturer.

13. The method as claimed in claim 12, wherein the acoustician or the clinic delivers the hearing aid to the patient.

* * * * *